United States Patent [19]

Gregg

[11] 4,384,826

[45] May 24, 1983

[54] METHOD AND APPARATUS FOR CONTROLLING COMMUNICATION WITH A COMPRESSOR UNLOADER CHAMBER

[75] Inventor: James E. Gregg, Eden, N.Y.

[73] Assignee: Tenneco, Inc., Houston, Tex.

[21] Appl. No.: 259,927

[22] Filed: May 4, 1981

[51] Int. Cl.[3] ..... F04B 49/02

[52] U.S. Cl. ..... 417/53; 417/275; 417/299; 92/60.5

[58] Field of Search ..... 417/275, 277, 299, 53; 92/60.5

[56] References Cited

U.S. PATENT DOCUMENTS

| | | | |
|---|---|---|---|
| 1,586,278 | 5/1926 | Bardenheuer . | |
| 1,587,015 | 6/1926 | Longacre . | |
| 1,588,257 | 6/1926 | Metzgar . | |
| 1,621,913 | 3/1927 | Longacre . | |
| 1,997,476 | 4/1935 | Wallene . | |
| 2,004,474 | 6/1935 | Schaer . | |
| 2,197,158 | 4/1940 | Saharoff . | |
| 2,241,195 | 5/1941 | Gehres . | |
| 2,261,911 | 11/1941 | Condit . | |
| 2,402,848 | 6/1946 | Senn . | |
| 2,536,184 | 1/1951 | Johnson . | |
| 2,570,624 | 10/1951 | Wyckoff . | |
| 2,575,085 | 11/1951 | Alyea . | |
| 2,635,585 | 4/1953 | Damgaard . | |
| 2,761,615 | 9/1956 | Prince . | |
| 2,833,462 | 5/1958 | Scheerer . | |
| 2,981,198 | 4/1961 | Nettel . | |
| 3,870,436 | 3/1975 | Remy | 417/299 |
| 3,878,770 | 4/1975 | Ashton . | |
| 3,972,652 | 8/1976 | Minnicino . | |
| 4,068,562 | 1/1978 | Frenkel . | |

*Primary Examiner*—Richard E. Gluck
*Attorney, Agent, or Firm*—Arnold, White & Durkee

[57] ABSTRACT

A compressor unloader system and method is disclosed, comprising a pneumatically controlled one-way valve member for controlling communication between an unloader chamber and a compression chamber of a compressor.

The one-way valve member has one surface exposed to the pressure of the unloader chamber. To close it a control mechanism is actuated to present a lower pressure to an opposing second surface, interior of the valve member, creating a pressure differential to urge the one-way valve member toward a closed position.

Temporary excesses of compression chamber pressures relative to unloader chamber pressures may bump the valve open to charge the unloader chamber with essentially maximum compression chamber pressure, thereby neutralizing the effect of the unloader chamber and fully loading the compressor.

The one-way valve member is biased toward an open position. Thus, when the pressure differential is removed by exposing the second, opposing surface of the one-way valve member to the same unloader chamber pressure as that to which the first surface is exposed, the valve opens to unload the compressor.

A method for controlling communication between an unloader chamber and a cylinder chamber of a compressor is also disclosed and claimed.

12 Claims, 4 Drawing Figures

METHOD AND APPARATUS FOR CONTROLLING COMMUNICATION WITH A COMPRESSOR UNLOADER CHAMBER

BACKGROUND OF THE INVENTION

This invention relates generally to the loading and unloading of gas compressors by controlling the effective volume of the working space in the compressor cylinder chamber, or compression chamber.

More particularly, this invention concerns a method and apparatus for maintaining valved control of communication between a cylinder chamber, and an unloader chamber which may be placed in communication with the working space of the cylinder chamber.

A wide variety of gases (including air, natural gas, and other gaseous materials) are often compressed by means of a compressor. Often the compressor takes the form of a reciprocating compressor. A portion of such a compressor is illustrated schematically at 10 in FIG. 1.

Such compressors 10 have one or more cylinders 12, with a suction valve 51, and a discharge valve 52 in or near one end of a cylinder 12. A piston 53 moves back and forth, or reciprocates, in the cylinder 12. The working space within the cylinder 12 defined by the piston 53 and the cylinder head 50 is referred to as the cylinder chamber 11.

When the piston 53 moves away from the cylinder head 50 (downwardly in FIG. 1), the piston 53 makes a suction stroke; the suction valve 51 is open; the discharge valve 52 is closed; and gas is drawn into the cylinder chamber 11 as the piston 53 moves away from the cylinder head 50.

When the piston 53 moves toward the cylinder head 50 (upwardly in FIG. 1), the piston 53 makes a compression stroke; the suction valve 51 is closed; the piston 53 moves toward the cylinder head 50 to compress gas in the cylinder chamber 11. The discharge valve 52 opens and the piston 53 urges a portion of the compressed gas out of the cylinder chamber 11 into the compressed gas line, manifold or header 54, which may be generically referred to as the "discharge header" 54.

The output pressure from the cylinder chamber 11 is a function of the compression ratio. The compression ratio may be defined as the ratio of the volume of compressible gas at the end of the suction stroke (when the piston 53 is farthest removed from the cylinder head 50), to the volume of compressible gas at the end of the compression stroke (when the piston 53 is closest to the cylinder head 50). The volume of compressible gas includes the gas in the cylinder chamber 11 and any gas that is in communication with the cylinder chamber. If additional volumes of gas are placed into communication with a given cylinder chamber 11, the effective volume of compressible gas will be enlarged.

For a given size cylinder 12 and piston 53, both the compression ratio and the driver load are high if the volume of the cylinder chamber 11 when the piston 53 is closest to the cylinder head 50 at the end of the compression stroke is very small. If the effective volume of the cylinder chamber 11 is enlarged, the compression ratio is reduced, the actual compression effected on each compression stroke is reduced, and the driver load on the compressor 10 is reduced.

One way of enlarging the effective volume of the cylinder chamber 11 is to provide an unloader chamber 13, which may be selectively placed into communication with the cylinder chamber 11 by means of an unloader valve 55. When the unloader valve 55 is open, the effective volume of the cylinder chamber 11 is enlarged, and the compression ratio and the driver load of the compressor 10 are both reduced. When the unloader valve 55 is closed, the effective volume of the cylinder chamber 11 is smaller and the compressor load is at its maximum.

A compressor unloading mechanism of the type shown schematically in FIG. 1 is useful when it is desired to have a gas compressor driver operate at rated load—which often is less than maximum full capacity. This invention relates to an improved means for maintaining valved control of communication between the cylinder chamber and the unloader chamber.

In the past, externally controlled unloader valves have been used which require a pressure regulator to step down gas pressure from the compressor output levels typically of 600 psi to a suitable control level of typically 125 psi. Other prior art devices have employed pressurized fluids which require external sources of pressure. Such devices have been unsatisfactory in that the relatively low control pressure must operate against the relatively high pressure in the compressor cylinder head chamber in order to close communication between the cylinder chamber and the unloader chamber.

Scheerer's U.S. Pat. No. 2,833,462 illustrate a prior art device wherein pressurized fluid must be introduced into a cylinder to move a hollow piston into a closed position to reduce the effective volume of the compressor cylinder head chamber. Scheerer requires an external source of pressurized fluid. The pressurized fluid, which is used to move the hollow piston, must work against the relatively high pressure in the cylinder head chamber.

Other prior art references of interest include U.S. Pat. Nos. 4,068,562; 2,261,911; 2,241,195; 1,588,257; 3,972,652; 1,621,913; 1,587,015; 2,761,615.

The features of the prior art devices which are discussed above are not intended to be exhaustive. Other features and problems exist. The above discussion does indicate that prior art devices have left room for significant and needed improvement.

SUMMARY OF A PREFERRED EMBODIMENT OF THE INVENTION

In accordance with the present invention means are provided for controlling the passage of gas between the unloader chamber and the cylinder chamber through a one-way valve biased toward open, wherein the valve has a first surface exposed to the pressure of the unloader chamber, and a second surface exposable to lower pressure (e.g. atmospheric pressure) whereby the pressure differential derived from pressures inherently in the compressor urges the valve toward the closed position.

Conveniently, controls for selectively controlling communication between the opposed or second surface of the one-way valve and the unloader chamber and the lower pressure may be included.

DETAILED DESCRIPTION OF A PREFERRED EMBODIMENT OF THE INVENTION

Figure 4:
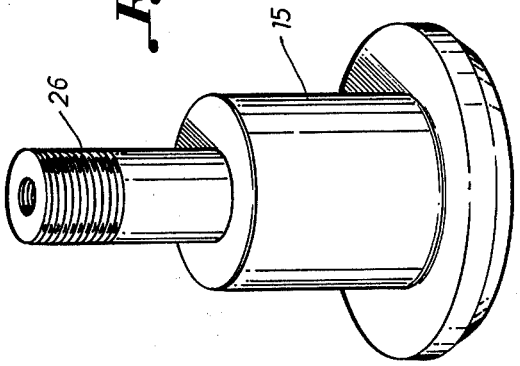
FIG. 4 is a perspective view of the unloader valve assembly shown in FIGS. 2 and 3.
Figure 1:
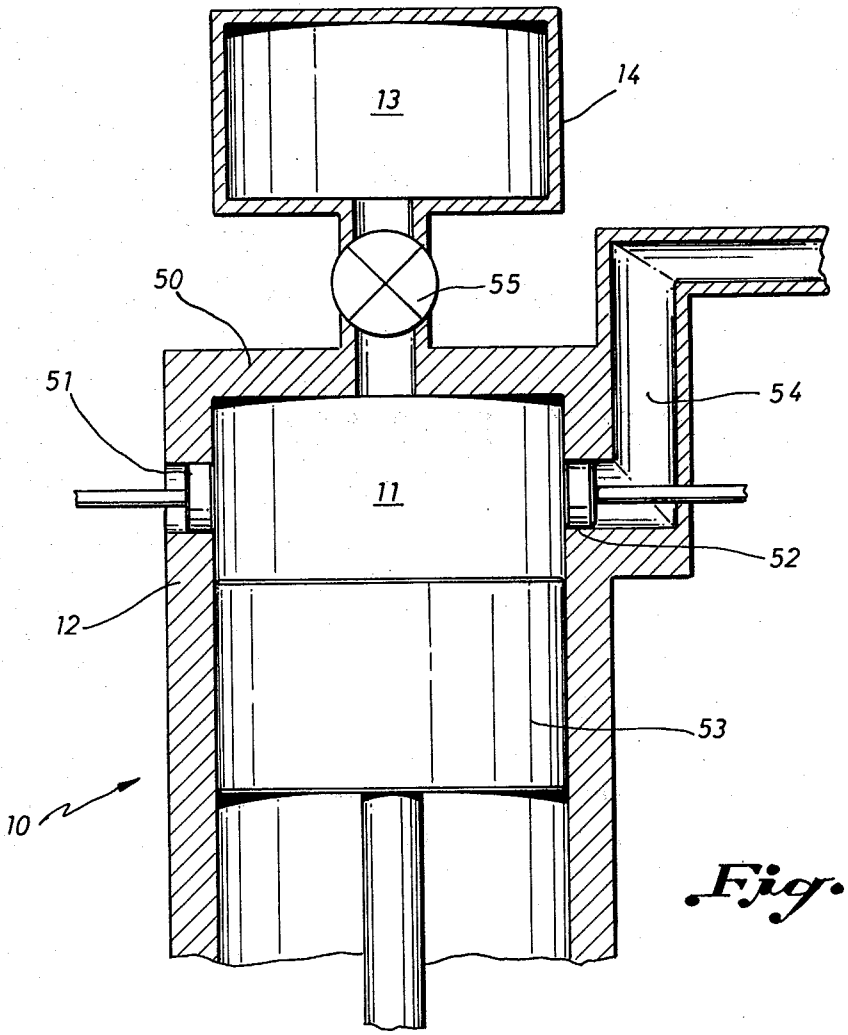
FIG. 1 is a schematic representation in sectional view of a reciprocating compressor with an unloader chamber.

Reciprocating gas compressors include at least one cylinder (normally more than one) partially illustrated in FIG. 1 at 12, and a reciprocating piston 53 movable therein to compress gas in the cylinder chamber 11. An unloader chamber 13 is illustrated as defined by a housing 14 adjacent the end of the cylinder 12.

Figure 2:
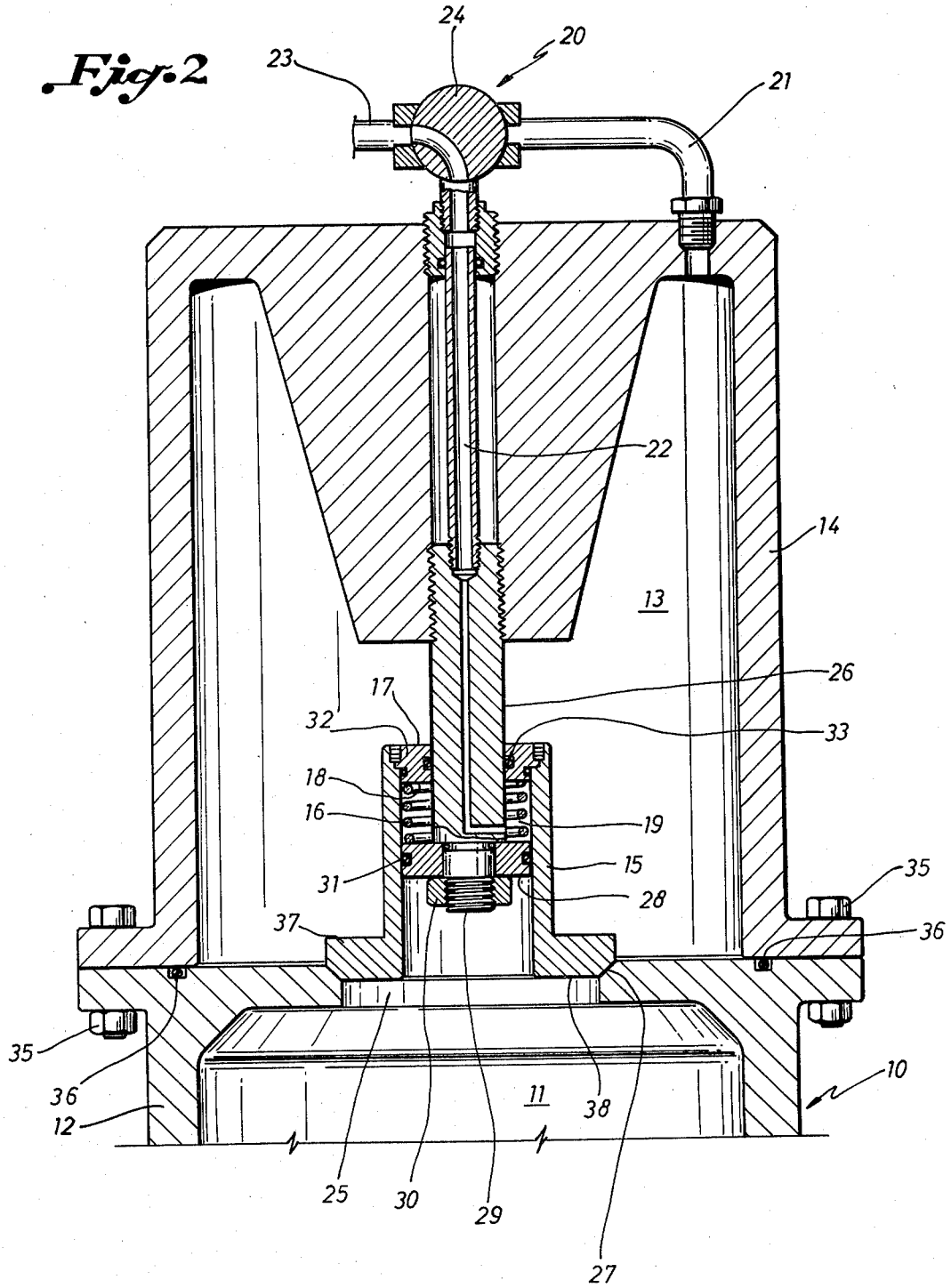
FIG. 2 is a schematic cutaway view showing more detail of a preferred embodiment of the unloader valve assembly (which is shown in the closed position), the unloader chamber, and the end of the cylinder chamber.

In accordance with this invention, means must be provided for closing and opening communication between the cylinder chamber 11 and the unloader chamber 13. As shown in FIG. 2, such means may take the form of a valve member 15. In a preferred embodiment, the valve member 15 is a one-way valve member, operable like a check valve, to inhibit the flow of gas from the unloader chamber 13 into the cylinder chamber 11 when the one-way valve member 15 is in a closed position, as shown in FIG. 2. As seen hereinafter the check valve 15 yields to high pressures in the cylinder chamber 11 until the unloader chamber 13 is so pressurized that the closing force which is derived from the unloader chamber pressure is sufficient to generally maintain the valve member closed, and by holding that pressure in unloader chamber 13 it effectively removes the unloader chamber 13 from communication with the cylinder chamber.

In the illustrative embodiment, means may be provided for biasing the valve member 15 in the open direction. Conveniently such means may take the form of a compression spring 16, operative between a stationary plug 28, and a head portion 32 of the movable valve member 15.

Figure 3:
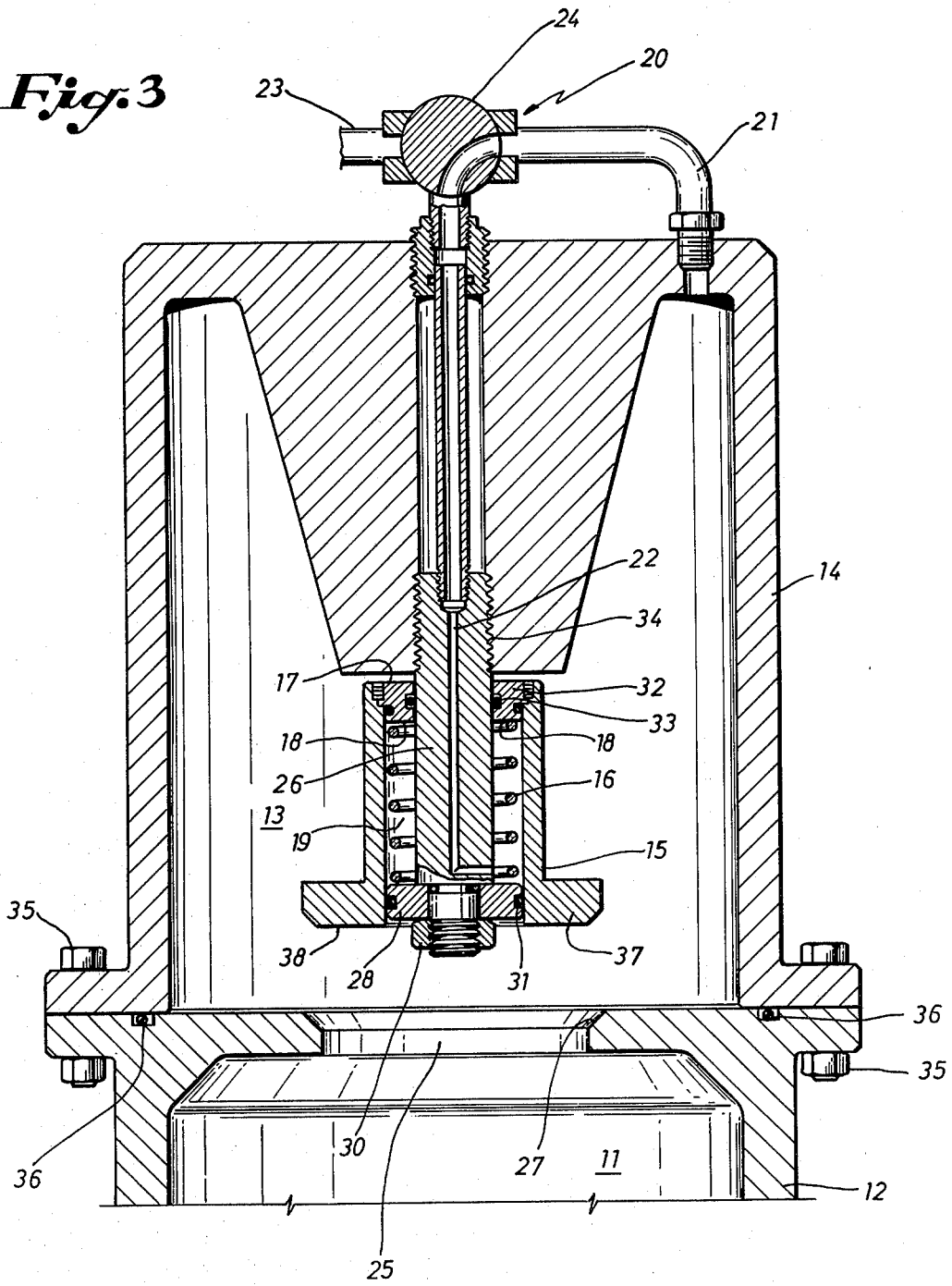
FIG. 3 is a schematic cutaway view of the same unloader valve assembly detailed in FIG. 2, shown in the open position.

A variety of arrangements of spring or elastomer or pneumatic biasing will occur to those in the art for use in different embodiments of this invention. As an example of pneumatic bias means, a check valve may be provided in line 21 which is operable to permit the one-way movement of gas from the unloader chamber 13 into a control chamber 19, defined by the interior 19 of the valve member 15, when the valve member 15 is in the open position illustrated in FIG. 3. In such an embodiment, the spring 16 may be omitted and the valve member 15 biased toward the open position by the one-way movement of gas into the control chamber 19. The check valve in line 21 would charge the control chamber 19 to the maximum pressure in the unloader chamber 13 while the compressor 10 is unloaded. Another example of pneumatic bias means could include passageway connecting line 21 directly to the header 54 instead of the unloader chamber 13 to bias the valve member 15 open. In yet another alternative embodiment the valve may be oriented upside down from the orientation illustrated, and so weighted that gravity upon the valve member could be the biasing force in lieu of spring 16.

Magnetic urging, electrostatic urging, or other biases, such as hydraulic biasing, may also be used. Conveniently the stationary plug 28 may be fixedly mounted by a rod-shaped valve guide 26 to the unloader housing 14.

In accord with this invention means are provided for actuating the valve member 15 in response to a pressure differential between the unloader chamber 13 and some lower pressure such as atmosphere. Conveniently such means may take the form of a valve member outside surface 17 exposed to unloader chamber pressure to urge the valve 15 to a closed position, and valve member inside surface 18 exposed to atmospheric pressure through a passageway 22 in valve guide 26 by means of a control mechanism 20 comprising a two-position control valve 24, as seen in FIG. 2. Since the pressure in the unloader chamber 13 is higher than atmospheric pressure, the valve member 15 can be closed against the biasing force of the spring 16.

With the initial strokes of the compressor piston 53 after closing of the valve 15, the pressure in the cylinder chamber 11 is increased to levels above that which was left in the unloader chamber 13 when the valve 15 first closed. On the upstroke of the piston 53, pressure on a surface 38, which is the cylinder chamber side of the valve 15, operating on the area of the valve 15 exposed to cylinder side pressures may cause the valve member 15 to bump open on the upstroke long enough for some gas to pass into the unloader chamber 13 and increase the pressure therein. The check-valve function of the valve member 15 retains the higher pressure in the unloader chamber 13. The "bump open" event may repeat on a second and third upstroke until the force derived from pressure in the unloader chamber operating on the areas of the valve 15 exposed thereto, is balanced by the force derived from pressure in the cylinder chamber 11 operating on the area of the valve 15 exposed thereto plus biasing forces, if any.

Thereupon, the valve 15 remains generally closed throughout each suction and discharge cycle, with the compressor 10 operating at its highest compression ratio, highest load, and highest output, for the unloader chamber 13 is not then effectively in communication with the cylinder chamber 11.

Threshold pressure:

The "bump open" event may be described in terms of a "threshold pressure." The pressure in the cylinder chamber 11 may, in practice, reach a value sufficiently great on the initial compression strokes of the piston to overcome the closing force upon the valve member 15. In other words, the pressure in the cylinder chamber 11 can exceed a certain threshold value sufficient to cause the valve member 15 to open slightly and permit gas to flow into the unloader chamber 13. The value of the threshold pressure level required to open the valve member 15 is a function of the pressure in the unloader chamber 13. The higher the pressure in the unloader chamber 13, the higher will be the value of the threshold pressure level necessary to open the valve member 15.

On each stroke of the piston that the pressure in the cylinder chamber 11 exceeds the threshold pressure level, the valve member 15 will open slightly, and gas will move into the unloader chamber 13. When the piston reciprocates to the suction stroke, the valve member 15 will seat and inhibit the flow of gas back into the cylinder chamber 11. The one-way movement of gas into the unloader chamber 13 will act to increase the pressure in the unloader chamber 13. The threshold pressure level necessary to open the valve member 15, which is determined in part by the pressure in the unloader chamber 13, will also increase to a higher value. With each initial compression stroke of the piston, the value of the threshold pressure necessary to open the valve member 15 will rise until the threshold pressure level generally equals the maximum pressure of the cylinder chamber 11. As long as the maximum pressure in the cylinder chamber 11 does not exceed the threshold pressure level, the valve member 15 will generally remain seated in the closed position.

An alternative embodiment of the invention could include a one-way valve or check valve between the cylinder chamber 11 and the unloader chamber 13, to permit the one-way movement of gas from the cylinder chamber 11 into the unloader chamber 13 when the valve member 15 is in the closed position to charge the unloader chamber 13 to a pressure level sufficient to raise the threshold pressure level to a value greater than or equal to the maximum pressure of the cylinder chamber 11.

Means must also be provided for opening the valve 15. Conveniently such means may take the form of a two-position valve 24 and appurtenant passageways 22 and 21 for effecting the opening of the valve 15.

As previously explained, the two-position valve 24, in the position of FIG. 2, connects the interior 19 of the valve member 15 and its surface 18 to atmospheric pressure via passageways 22 and 23, to effect the closing of the valve 15. The two-position valve 24 may also be turned to the position of FIG. 3 whereby the control chamber 19 and the interior surface 18 are connected by passageways 22 and 21 to the unloader chamber 13. This exposes both side 17 and side 18 of the valve member 15 to equal pressure—the pressure of the unloader chamber 13—whereby the valve member 15 is urged open at least in part by the biasing spring 16, thereafter affording full fluid communication between the unloader chamber 13 and the cylinder chamber 11.

This of course reduces the compression ratio and decreases the compressor output and the driver load of the compressor 10.

Alternatives to the control valve and conduit mechanism which are here illustrated by way of example, will be obvious to those in the art. For example, instead of a single two-position valve 24, two separate valves might be used in co-ordinated manner to effect the same result.

Having unloaded the compressor by turning the valve 24 to connect unloader pressure to the interior 19 of the valve member 15, it is equally easy then to load the compressor by returning the valve 24 to the position of FIG. 2 thereby connecting the interior 19 of valve member 15 to atmosphere and closing the valve as previously explained.

In practice, the pressure in the unloader chamber 13 is large in comparison to atmospheric pressure even when the compressor 10 is unloaded. The greater the difference between the pressure in the unloader chamber 13 and the lower pressure in the control chamber 19, the larger the closing force will be. Consequently, the higher the cylinder pressure the more effective the valve member 15 seals. The reverse is true in many prior art devices.

In the example of the invention illustrated using a reciprocating compressor where the compression occurs in a cylinder chamber, the compression chamber has been referred to as a "cylinder chamber." But in a rotary compressor of the Wankel type, the compression chamber would be of a different shape. Thus, the term "compression chamber" as used in the claims is generic to both the compression end of the cylinder chambers heretofore discussed, and the compression chamber of other forms of compressors.

SUMMARY OF ADVANTAGES OF THE INVENTION

It will be appreciated that certain significant advantages are provided by the present invention.

In particular, an apparatus according to the present invention permits the valved control of communication between the cylinder chamber and the unloader chamber utilizing the differential in pressure between the pressure in the unloader chamber and a lower pressure like atmospheric pressure to actuate the valve member to close. An external source of compressed gas or fluid under pressure is not required to effect movement of the valve member. Instead, the pressures inherent in the compression function are utilized.

Control is effected as simply as by turning a control valve which can be remotely located for convenience. The operation of the valve member is always with the pressures operating upon it and never against them. This saves material, weight, and construction costs so as to create greater reliability of operation at the same time.

The above disclosure provides an example of a presently preferred embodiment of the invention. Although the present invention has been described in conjunction with the specific embodiment of the invention that is illustrated, it is evident that many alternatives, modifications, and variations will be apparent to those skilled in the art in light of the foregoing disclosure. Accordingly, this description is to be construed as illustrative only for the purpose of teaching those skilled in the art the manner of carrying out the invention, and is not to be construed as a limitation of the invention as defined in the following claims.

What is claimed is:

1. An apparatus for controlling communication between a compression chamber of a compressor and an unloader chamber, comprising:

a valve member for closing and opening communication between the compression chamber and the unloader chamber, the valve member having a first surface exposed to the pressure of the unloader chamber;

bias means for biasing the valve member open; and, a control valve for selectively exposing a second surface of the valve member to a pressure that is lower than the pressure of the unloader chamber to create a pressure differential to urge the valve member toward a closed position, the control valve being adapted to selectively expose said second surface of the valve member to the pressure of the unloader chamber thereby removing the pressure differential to allow the bias means to urge the valve member toward an open position.

2. An apparatus for controlling communication between a compression chamber of a gas compressor and an unloader chamber, comprising:

an opening to allow communication between the unloader chamber and the cylinder chamber;

a valve member operable to inhibit the flow of gas from the unloader chamber into the cylinder chamber when the valve member is in a closed position, the valve member having a first surface exposed to the pressure of the unloader chamber;

bias means for biasing the valve member toward an open position;

a control mechanism adapted to selectively expose an opposed second surface of the valve member to the pressure of the unloader chamber or to a pressure that is lower than the pressure of the unloader chamber, whereby when the opposed second surface of the valve member is exposed to the lower pressure a pressure differential will be created between the first surface and the opposed second surface of the valve member operable to urge the valve member toward the closed position, and whereby when the opposed surface of the valve member is exposed to the pressure of the unloader chamber the pressure differential will disappear and the bias means will be allowed to urge the valve member toward the open position.

3. An apparatus for controlling communication between a compression chamber of a gas compressor and an unloader chamber, comprising:

an opening allowing the flow of gas between the unloader chamber and the cylinder chamber;

a one-way valve member operable to inhibit the flow of gas from the unloader chamber into the cylinder chamber through the opening when the one-way valve member is in a closed position, the one-way valve member having a first surface exposed to the pressure of the unloader chamber;

a valve guide adapted to guide the one-way valve member between an open position and the closed position;

bias means for biasing the one-way valve member toward the open position;

a first passageway adapted to selectively connect an opposing surface of the one-way valve member to atmosphere to create a pressure differential between the first surface of the one-way valve member and the opposing surface of the one-way valve member operable to urge the one-way valve member toward the closed position;

a second passageway adapted to selectively place the opposing surface of the one-way valve member into communication with the unloader chamber to remove said pressure differential between the first surface of the one-way valve member and the opposing surface of the one-way valve member, to thereby allow the bias means to urge the one-way valve member toward the open position; and, a control valve operable to selectively control communication between the opposing surface of the one-way valve member and the first and second passageways.

4. The apparatus according to claim 1, wherein said valve member comprises:

a one-way valve member operable to inhibit the flow of gas from the unloader chamber into the compression chamber when the one-way valve member is in a closed position, and operable to permit the one-way passage of gas from the compression chamber into the unloader chamber when the pressure in the compression chamber generally exceeds a threshold pressure level necessary to open the one-way valve member, thereby increasing the pressure in the unloader chamber until a net closing force upon the valve derived from the unloader chamber pressure substantially equals a net opening force upon the valve derived from the bias means and the compression chamber pressure.

5. The apparatus according to claim 1, or claim 2, wherein the lower pressure is generally equal to atmospheric pressure.

6. In a reciprocating gas compressor, having a cylinder chamber defined by a compressor cylinder and a piston movable therein to compress gas in the cylinder chamber, and having an unloader chamber to reduce loading on the compressor when the unloader chamber is in communication with the cylinder chamber, improved apparatus for maintaining valved control of communication between the cylinder chamber and the unloader chamber, comprising:

a one-way valve adapted to inhibit the flow of gas from the unloader chamber into the cylinder chamber when the one-way valve is in a closed position;

bias means for biasing the one-way valve toward an open position; and, a closure mechanism operable to assert a closing force upon the one-way valve which is derived from the unloader chamber pressure for overcoming the bias means to urge the one-way valve toward the closed position.

7. An apparatus comprising in combination:

a compressor, having a cylinder chamber defined by a compressor cylinder and a piston movable therein to compress gas in the cylinder chamber;

an unloader chamber operable to reduce loading on the compressor when the unloader chamber is in fluid communication with the cylinder chamber;

a valve member for closing and opening communication between the cylinder chamber and the unloader chamber, the valve member having a first surface exposed to the pressure of the unloader chamber;

bias means for biasing the valve member open; and, a control mechanism adapted to selectively expose a second surface of the valve member to a pressure lower than that of the unloader chamber thereby creating a pressure differential to overcome the bias means and urge the valve member toward a closed position, and being adapted to selectively expose said second surface of the valve member to the pressure of the unloader chamber thereby removing the pressure differential to allow the bias means to urge the valve member toward an open position.

8. The apparatus of claim 7, wherein said valve member comprises:

a one-way member operable to inhibit the flow of gas from the unloader chamber into the cylinder chamber when the one-way valve member is in a closed position, and operable to permit the one-way passage of gas from the cylinder chamber into the unloader chamber when the pressure in the cylinder chamber generally exceeds a threshold pressure level necessary to open the one-way valve member, thereby increasing the pressure in the unloader chamber until the threshold pressure level necessary to open the one-way valve member generally equals the maximum pressure in the cylinder chamber.

9. An apparatus for use in a compressor having a compression chamber and an unloader chamber, comprising:

a valve member for closing and opening fluid communication between the compression chamber and the unloading chamber;

said valve member having first, second and third surfaces exposable to fluid pressures;

said first surface being exposable to the pressure in the unloader chamber;

said second surface being selectively exposable either (i) to the pressure in the unloader chamber, or (ii) to a lower pressure whereby there is generated a valve-closing force responsive to the excess of the unloader pressure over the lower pressure;

said third surface being exposed to the pressure in the compression chamber when the valve member is in a closed position, the compression chamber pressure acting on the third surface in a direction tending to open the valve member in opposition to the valve-closing forced derived from the unloader chamber pressure acting to close the valve member, whereby when the valve is nominally closed it can nevertheless be bumped open momentarily by temporary high pressure in the compression chamber which is sufficient to overcome the valve-closing force.

10. A method for controlling communication between a compression chamber of a gas compressor and an unloader chamber, comprising the steps of:

biasing a valve member toward an open position;

exposing a first surface of the valve member to the pressure of the unloader chamber;

exposing a second surface of the valve member to a pressure lower than the pressure of the unloader chamber to create a pressure differential acting upon the valve member to urge the valve member toward a closed position; and, exposing said second surface of the valve member to the pressure of the unloader chamber to equalize the pressures acting upon the valve member thereby allowing the valve member to be biased open.

11. A method for controlling communication between a compression chamber of a gas compressor and an unloader chamber, comprising the steps of:

biasing a valve member toward an open position;

exposing a first surface of the valve member to the pressure of the unloader chamber;

exposing a second surface of the valve member to atmospheric pressure to create a pressure differential acting upon the valve member to urge the valve member toward a closed position; and exposing said second surface of the valve member to the pressure of the unloader chamber to equalize the pressures acting upon the valve member thereby allowing the valve member to be biased open.

12. A valve for controlling communication between a cylinder chamber of a gas compressor and an unloader chamber, comprising:

a rod-shaped valve guide having a first end adapted for attachment to an unloader chamber housing;

a stationary plug coaxially fixed to a second end of the rod-shaped valve guide;

a cylindrical-shaped valve member coaxially disposed upon the rod-shaped valve guide for reciprocal movement, having an outer surface exposed to the pressure of an unloader chamber, and forming an annular control chamber defined by the cylindrically-shaped valve member, the stationary plug and the rod-shaped valve guide, the valve member being adapted to inhibit fluid flow to the cylinder chamber from the unloader chamber when the valve member is in a closed position, the valve member being adapted to be urged toward the closed position when the pressure in the control chamber is generally lower than the pressure upon said outer surface of the valve member;

a spring interposed between the stationary plug and the valve member, the spring being adapted to bias the valve member toward an open position; and, a passageway placing said first end of the rod-shaped valve guide in communication with the control chamber, the passageway being adapted to cooperate with a control mechanism for selectively placing the control chamber into communication with atmosphere or into communication with the unloader chamber, whereby when the passageway is placed into communication with atmosphere a pressure differential may be created to urge the valve member toward a closed position using the pressures inherent in the compression function to generate a closing force, and whereby when the passageway is placed into communication with the unloader chamber, the pressure differential may be removed to eliminate the closing force and allow the spring to bias the valve member open.

* * * * *